US006392352B1

(12) United States Patent
Walters et al.

(10) Patent No.: US 6,392,352 B1
(45) Date of Patent: May 21, 2002

(54) BURNOUT PROTECTION FOR LAMPS WIRED IN SERIES

(75) Inventors: William R. Walters, Hudson; Laszlo Lieszkovszky, Mayfield Heights, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/685,241

(22) Filed: Oct. 10, 2000

(51) Int. Cl.[7] ..... H01J 1/60
(52) U.S. Cl. ..... 315/129; 362/276
(58) Field of Search ..... 315/129, 130, 315/131, 132, 133; 362/276

(56) References Cited

U.S. PATENT DOCUMENTS 2,489,649 A * 11/1949 Kuever, Jr. ..... 315/129
2,531,345 A * 11/1950 Rikard ..... 250/27.5
5,168,198 A * 12/1992 Watanabe ..... 315/130
5,412,222 A * 5/1995 Hejazi ..... 250/588

FOREIGN PATENT DOCUMENTS

GB 0448358 A2 * 9/1991

* cited by examiner

*Primary Examiner*—Don Wong
*Assistant Examiner*—Thuy Vinh Tran
(74) *Attorney, Agent, or Firm*—Fay, Sharpe, Fagan, Minnich & McKee, LLP

(57) ABSTRACT

A plurality of lamps are connected in series. A plurality of burnout detector mechanisms are provided where one of the burnout detector mechanisms from the plurality is connected across a corresponding lamp of the plurality of serially connected lamps. When a lamp in the series enters a failure state, the burnout detector mechanism is activated providing an indication as to the burned out lamp. Depending upon the values provided in the burnout detector mechanism and the type of lamps, the remaining lamps will either enter an OFF state, or a low-light glow state.

14 Claims, 2 Drawing Sheets

BURNOUT PROTECTION FOR LAMPS WIRED IN SERIES

BACKGROUND OF THE INVENTION

The present invention relates to lamp lighting circuits, and more particularly to a circuit which indicates a failure of a lamp within a lighting system where the lamps are connected in series.

Environments exist where it is desirable to implement lamps wired in series. Such situations may include having a low voltage lamp which provides better performance than a higher voltage equivalent lamp, or when a higher voltage lamp is not practical or feasible due to wire size limitations or for other parameter requirements. For example, in the United States the standardized input power line is 120-volt a.c. However, a high-efficiency quartz halogen lamp has not be designed for efficient operation at the 120-volt a.c. input line. Rather, quartz halogen lamps operate most efficiently with a low-voltage coil or filament, in order to obtain a high lumen-per-watt efficiency output. Therefore, to operate a low-voltage lamp (e.g. a 40-watt quartz halogen lamp) it is necessary to provide a ballast for each lamp to limit the 120-volt a.c. input to an appropriate lamp operating voltage. However, ballasts are at times bulky and add economic cost to lamp lighting systems.

A manner in which low-voltage lamps may be operated without the implementation of a ballast is by placing the lamps in series. For example, if 120-volt a.c. input line is considered as being standard, placing three 40-volt lamps in series allows each lamp to operate at its normal rated voltage.

A significant obstacle to wiring lamps in series however, is that when a lamp in the series fails, the entire circuit is broken and all lamps in the series are deactivated. In this situation, replacing the failed lamp requires a pick-and-choose solution, where lamps are randomly replaced to determine whether a selected lamp has failed. This requires the lamp system to be deactivated. Next, a lamp is randomly selected and removed from the system, a new lamp is inserted to replace the removed lamp, and the lighting system is supplied with power. If the replaced lamp is not the failed lamp, the process is repeated until the failed lamp is found.

This process is tedious and inefficient and discourages the practice of placing lamps in a series arrangement, even when such a configuration would be otherwise beneficial.

Therefore, it has been considered desirable by the inventors to develop a mechanism which provides a clear indication of which lamp in a series of lamps has failed, in order to provide an efficient manner of replacing the failed lamp.

SUMMARY OF THE INVENTION

A plurality of lamps are connected in series. A plurality of burnout detector mechanisms are provided where one of the burnout protection mechanisms from the plurality is connected across a corresponding lamp of the plurality of serially connected lamps. When a lamp in the series enters a failure state, the burnout detector mechanism is activated providing an indication as to the burned out lamp. Dependant upon the values provided in the burnout detector mechanism and the type of lamps, the non-failed lamps will either enter an OFF state, or a low-light glow state when a burnout detection mechanism is active.

DETAILED DESCRIPTION OF THE INVENTION

Figure 1:
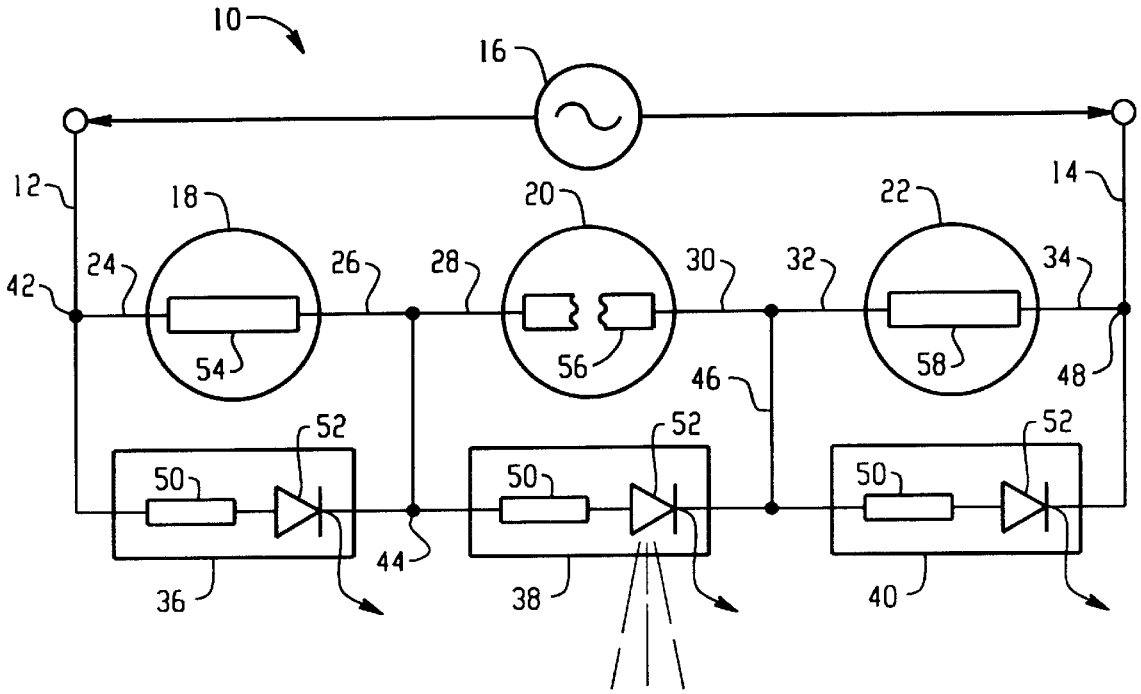
FIG. 1 is a schematic diagram of a plurality of lamps configured in a series with each other, and including a burnout detector mechanism associated with each of the lamps.

FIG. 1 is a schematic diagram of a lighting system 10 according to the teachings of the present invention. Lighting system 10 includes a first input line 12, and a second input line 14, supplied by a a.c. source 16. The a.c. source 16 may be any value appropriate for the powering of lighting system 10. In the United States, the standard lighting supply is a 120-volt a.c. source and in Europe it is a 220-volt a.c. source.

System 10 illustrates a lamp lighting system having three lamps 18–22 connected to each other in a series configuration. It is to be appreciated however, that the present invention may be used in connection with other numbers of lamps such as two, or more than three, as long as there is a sufficient voltage supply to operate the lamps of the system.

The present invention will function with lamps of many varieties, including quartz-halogen high-efficiency lamps, neon lamps, xenon lamps, krypton lamps, incandescent lamps, or other low-voltage lamps known in the industry. For example, if operating in North America, the 120-volt a.c. input lamp fixtures could include five 24 low-voltage a.c. lamps in the series. In Europe where the input standardized voltage is 220-volts a.c., it would be possible to operate the two 120-volt a.c. voltage lamps in series, or nine 24-volt a.c. lamps, or eighteen 12-volt a.c. lamps.

As noted, lamps 18, 20 and 22 are wired in a series arrangement with each other. More particularly, lamp 18 has a first end 24 connected to first input 12. A second end 26 of lamp 18 is connected to a first end 28 of lamp 20. A second end 30 of lamp 20, is connected to a first end 32 of lamp 22, and the second end 34 of lamp 22 is connected to the second input line 14.

Burnout detector mechanism 36, 38 and 40 are connected across respective lamps 18, 20 and 22. Burnout detector 36 is connected across lamp 18 by connection at a first end to node 42, which connects to input line 12, and at a second end at node 44 which in turn connects between second end 26 of lamp 18 and first end 28 of lamp 20. Node 44 also connects burnout detector 36 to a first end of burnout detector 38. A second end of burnout detector 38 is connected to burnout detector 40 at node 46, which also connects between second end 30 of lamp 20 and first end 32 of lamp 22. A second end of burnout detector 40 is connected at node 48 to the input line 14, and also the second end 34 of lamp 22.

In this embodiment each burnout detector 36, 38 and 40 is configured by a resistor 50 and light-emitting diode (LED) 52. In this embodiment the resistors and LEDs for each burnout detector will be of substantially equal value. It is to be understood that burnout detector mechanisms 36, 38 and 40 may be configured other than with resistor 50 and LED 52. For example, LED 52 may be replaced with a neon lamp or other low wattage light source. Further components other than a resistor may be used to drop the voltage for the detector mechanism.

During normal operation, when all lamps 18, 20 and 22 are functional and power has been applied to the system, the lamps are in an operational state. At this time sufficient current is flowing through filaments of coils 54, 56 and 58 of respective lamps 18, 20 and 22. During this period, burnout detector mechanisms, 36, 38 and 40 are non-functional. When one of the lamps, such as lamp 20, enters a failed state (i.e. filament 56 fails to a burn out condition), a high, substantially infinite impedance exists in lamp 20. This causes current flow to be diverted through burnout detection mechanism 38, wherein resistor 50 of burnout mechanism 38 generates a sufficient voltage to cause LED 52 of mechanism 38 to light. At the same time, there will be insufficient current flow through lamp 18 and lamp 22 such that these lamps have a cold filament whereby minimal resistance exists within the lamps and the filament acts as a short.

Due to the insufficient voltage and current flow through lamps 18 and 22, they are in a non-active state. Therefore no lamps within lighting system 10 are operational except for LED 52. This allows a user to identify which one of lamps 18, 20, 22 is in a failure mode. A user may then remove the power source 16 deactivating the circuit. Lamp 20 can then be removed and replaced with a new lamp. Once the new lamp has been inserted into lamp system 10, and power has been restored, lamp 18, new lamp 20 and lamp 22 will again be activated and the LED indicating lamp 52 of burnout mechanism 38 will be deactivated.

Thus, burnout detector mechanisms 36, 38, 40 will immediately indicate when a lamp with which it is associated becomes non-functional. This configuration eliminates the inconvenience of all lights of a system deactivating, without an indication as to which lamp in the series has failed. The present invention provides immediate and continuous identification of the failed lamp.

When burnout detector mechanism 38 is operational, lamps 18 and 22 have cold filaments. These are described as cold filaments when there is insufficient current through the filaments to light the lamp. In this manner, the corresponding burnout detector mechanisms 36 and 40 will not light.

In a situation where two or more of the lamps in a system are in a failure mode (burned out), each of the associated burnout detection mechanisms will be active.

Resistance 50 in burnout detector mechanisms 36, 38, 40 are selected such that they will drop the system voltage to a level that non-failed lamps are no longer able to stay active. In the embodiment where lamp 20 has failed, the path of the current is through lamp 18 which acts substantially as a short, and therefore minimal resistance, the current then flows through resistor 50 of mechanism 38 which is the current limiting resistor for LED 50. Resistor 50 in this embodiment will limit the current down to a few milli-amps thereby lighting LED 52. The current then passes through the cold filament of lamp 22 which again has very low resistance.

In an embodiment using a 120v a.c. input to light LED 52, it is desirable to draw approximately 10 milli-amps. To draw 10 milli-amps, resistor 50 will be approximately 120K ohms (ohms law −120 volts a.c. ÷10 milli-amps). The indicator, LED 52, needs to be sized with an appropriate peak inverse voltage (PIV) protection to ensure against breakdown of the diode. In this example, an acceptable peak inverse voltage rating would be 40 volts (where peak inverse voltage is determined by 120-volt input for three 40volt lamps).

In an another embodiment, burnout detection mechanisms 36, 38 and 40 may be configured with a resistance 50 of a value smaller than in the foregoing embodiment. This resistance may be selected such that the current drawn down to the selected burnout detection mechanism does not cause the filaments of the remaining lamps to turn entirely cold. Thus there will be, in this embodiment, sufficient current within the remaining good lamps to provide at least a low-level glow light output from these non-failed lamps.

Figure 2:
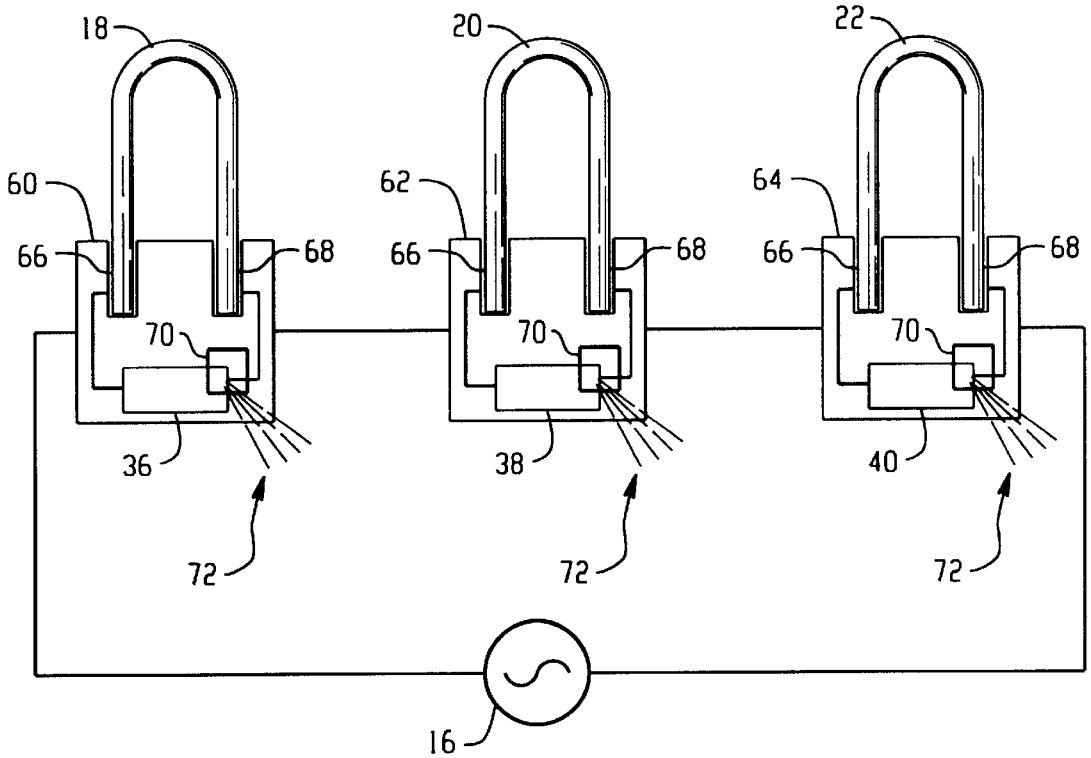
FIG. 2 shows the burnout detector mechanisms located within a socket or connector designed to hold a lamp.

Turning to FIG. 2, illustrated is an embodiment where lamps 18, 20 and 22 are inserted within corresponding sockets 60, 62 and 64. Each socket has an internally connected burnout detector mechanism 36, 38 and 40. The wiring of these burnout detectors within the sockets correspond to the wiring diagram of FIG. 1. Thus in this embodiment, upon insertion of the lamps 18, 20 and 22 into the corresponding sockets 60, 62 and 64, burnout detectors 36, 38 and 40 are placed across a corresponding lamp of the plurality of lamps connected in series. More particularly, when considering lamp 18, upon insertion into socket 60, ends of lamp 18 connect with electrical connectors 66 and 68. A burnout detector mechanism 36 is connected to the electrical connectors 66 and 68 in a configuration such that the mechanism 36 is placed in parallel across lamp 18 in a manner similar to that discussed in connection with FIG. 1.

Sockets 60, 62, 64 are designed such that an aperture 70 exists, wherein the indicator (e.g. LED 52) of detectors 36, 38, 40 is able to transmit light 72 through these openings when detectors 36, 38, 40 are activated.

Figure 3:
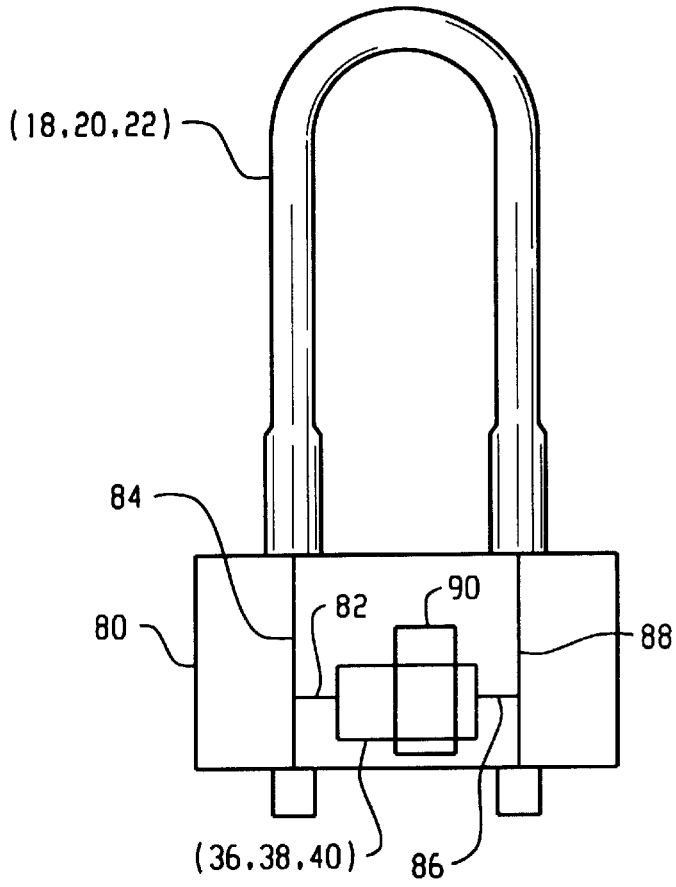
FIG. 3 illustrates the burnout detector mechanism located within the lamp in an integrated fashion.

In a further embodiment, as illustrated in FIG. 3, each burnout detector 36, 38 and 40 may be configured within base 80 of lamps 18, 20 and 22. In this embodiment, burnout detector mechanisms 36, 38 and 40 are inserted within base 80 and connected at a first end 82 to a first lead 84 and at a second end 86 to a second lead 88 of lamps 18, 20 and 22. Base 80 also includes an aperture or window portion 90 to allow the passage of light from burnout detector mechanisms 36, 38 and 40 upon activation.

Figure 4:
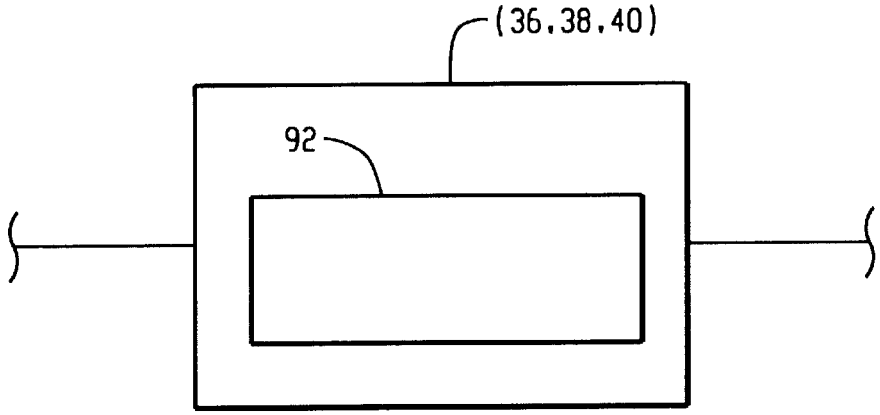
FIG. 4 is a block diagram of a detector mechanism using an audible indicator.

While the present invention has been disclosed where the indication mechanism is a light-emitting mechanism, such as an LED, neon lamp, or other low-wattage light source, it is to be appreciated that other indicators may be used. For example, as shown in FIG. 4, the indicator may be a sound indicator 92 such as a small amplifier circuit emitting a predetermined tone.

While the invention has been described with respect to specific embodiments by way of illustration, modifications and changes will occur to those skilled in the art. It is, therefore, to be understood that the appended claims are intended to cover all such modifications and changes as which fall within the true scope and spirit of the invention.

What is claimed is:

1. A lamp system to be powered by a power source comprising:

a plurality of lamps;

a plurality of lamp sockets connected in a serial configuration, wherein the plurality of lamps are connected in series by insertion into the plurality of lamp sockets; and a plurality of burnout detector mechanisms each one of the burnout detector mechanisms configured with one of the plurality of lamp sockets such that the insertion of the lamps into the lamps sockets connects the burnout detector mechanism across a corresponding lamp of the plurality of lamps, wherein upon failure of one of the plurality of lamps, the corresponding one of the plurality of burnout detector mechanisms becomes activated.

2. The invention according to claim 1 wherein the plurality of burnout detector mechanisms include a light indicator.

3. The invention according to claim 2 wherein each lamp includes a base portion in which is held one of the plurality of burnout detector mechanisms.

4. The invention according to claim 3 wherein said aperture is located in the lamp base.

5. The invention according to claim 1 wherein the burnout detector mechanisms are configured such that activation of one burnout detector mechanism causes remaining non-failed lamps of the system to stop emitting light.

6. The invention according to claim 1 wherein the burnout detector mechanisms are configured such that activation of one burnout detector mechanism causes remaining non-failed lamps of the system to enter a low light emitting state, whereby the non-failed lamps output less light than when all burnout detector mechanisms are not active.

7. The invention according to claim 1 wherein each burnout detector mechanism includes a light emitting device which outputs visible light when the burnout detector mechanism is activated.

8. The invention according to claim 7 wherein said aperture is located in the lamp socket.

9. The invention according to claim 1 wherein the burnout detector mechanism is an audible indicator.

10. A lighting system having a burnout detector configuration for a plurality of lamps wired in series, the system comprising:

a first input line;

a second input line;

a first lamp having a first end and a second end, the first end connected to the first input line;

a second lamp having a first end and a second end, the first end connected to the second end of the first lamp and the second end of the lamp connected to the second input line;

a first burnout detector mechanism connected across the first lamp; and a second burnout detector mechanism connected across the second lamp, wherein upon failure of the first lamp, the first burnout detection mechanism is activated and upon failure of the second lamp the second burnout detection mechanism is activated, wherein the first burnout detector mechanism is located within the base portion of the first lamp, and the second burnout detector mechanism is located within the base portion of the second lamp.

11. The invention according to claim 10 wherein the first lamp and the second lamp each include a base portion.

12. The invention according to claim 11 wherein the first burnout detector mechanism and the second burnout detector mechanism include an indicator which emits visible light.

13. The invention according to claim 12 wherein the light emitted by the corresponding indicator is transmitted out of the corresponding base.

14. The invention according to claim 10 further including first and second lamp sockets connected in a serial configuration, wherein the first and second lamps are connected in series by insertion into the respective lamp sockets, and where each lamp socket is configured with one of the burnout detector mechanisms and said aperture positioned to allow light from the burnout detector mechanism to be emitted from the lamp sockets.

* * * * *